US006705097B2

(12) United States Patent
So et al.

(10) Patent No.: US 6,705,097 B2
(45) Date of Patent: Mar. 16, 2004

(54) COMPRESSOR-CONTROLLING DEVICE AND METHOD FOR AIR CONDITIONER COMPRISING A PLURALITY OF COMPRESSORS

(75) Inventors: Min Ho So, Seoul-si (KR); Won Hee Lee, Seoul-si (KR); Chang Min Choi, Seoul (KR); Yoon Jei Hwang, Seoul (KR); Deok Huh, Buchun-si (KR); Cheol Min Kim, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/377,630

(22) Filed: Mar. 4, 2003

(65) Prior Publication Data

US 2004/0003606 A1 Jan. 8, 2004

(30) Foreign Application Priority Data

Jul. 3, 2002 (KR) ..... 10-2002-0038376

(51) Int. Cl.[7] ..... G05D 23/32

(52) U.S. Cl. ..... 62/158; 62/175

(58) Field of Search ..... 62/157, 158, 175, 62/228.5

(56) References Cited

U.S. PATENT DOCUMENTS 3,599,006 A * 8/1971 Harris ..... 307/39
3,636,369 A * 1/1972 Harter ..... 307/141.4
3,817,052 A * 6/1974 Connelly et al. ..... 62/158
5,050,397 A * 9/1991 Sugiyama et al. ..... 62/175
5,560,422 A * 10/1996 Matumoto et al. ..... 165/259

* cited by examiner

*Primary Examiner*—Marc Norman
(74) *Attorney, Agent, or Firm*—Greenblum & Bernstein, P.L.C.

(57) ABSTRACT

Disclosed are compressor-controlling device and method for an air conditioner comprising a plurality of compressors. The compressor-controlling device comprises a movable timer for sensing a stopping time (t) of stopped compressors selected from the plural compressors according to a decrease of a cooling load, a comparison unit for determining whether the stopping time (t) sensed by the movable timer exceeds a designated time (T), and a control unit for re-operating the stopped compressors after a lapse of the designated time (T) when the cooling load is increased, in case the comparison unit judges that the stopping time (t) does not exceed the designated time (T). When the cooling load is increased, the stopped compressors for satisfying the decrease of a cooling load are re-operated after the lapse of the designated time. Therefore, the compressor-controlling device assures the reliability of its system.

9 Claims, 3 Drawing Sheets

COMPRESSOR-CONTROLLING DEVICE AND METHOD FOR AIR CONDITIONER COMPRISING A PLURALITY OF COMPRESSORS

BACKGROUND OF THE INVENTION

1. Field of the Invention

The present invention relates to compressor-controlling device and method for an air conditioner comprising a plurality of compressors, and more particularly to compressor-controlling device and method for an air conditioner comprising a plurality of compressors, in which stopped compressors selected from the plural compressors are re-operated so as to satisfy an increased cooling load after a lapse of a designated time taken to equalize pressures at inlets and outlets of the stopped compressors.

2. Description of the Related Art

Generally, an air conditioner comprises a compressor for compressing a gaseous refrigerant in a low-temperature and low-pressure state so as to convert it into a high-temperature and high-pressure state, an outdoor heat exchanger for condensing the gaseous refrigerant in the high-temperature and high-pressure state compressed by the compressor so as to convert it into a liquid refrigerant in a mid-temperature and high-pressure state, an expansion device for decompressing the liquid refrigerant in the mid-temperature and high-pressure state condensed by the outdoor heat exchanger so as to convert it into a low-temperature and low-pressure state, and an indoor heat exchanger for evaporating the liquid refrigerant in the low-temperature and low-pressure state decompressed by the expansion device so as to convert it into a gaseous refrigerant in a low-temperature and low-pressure state.

Further, recently, the air conditioner employs a plurality of compressors having different capacities so as to variably change the total capacity of the operated compressors according to cooling loads, thereby properly satisfying the variation of the cooling load and optimizing cooling efficiency.

FIG. 1 is a block diagram of a conventional capacity variable air conditioner.

As shown in FIG. 1, the capacity variable air conditioner comprises first and second compressors 2 and 3, an outdoor heat exchanger 4, an expansion valve 6, and an indoor heat exchanger 8. The first and second compressors 2 and 3 compress a gaseous refrigerant in a low-pressure state so as to convert it into a high-temperature and high-pressure state. The outdoor heat exchanger 4 condenses the gaseous refrigerant compressed by the first and second compressors 2 and 3 so as to convert it into a liquid refrigerant in a mid-temperature and high-pressure state. The expansion valve 6 decompresses the liquid refrigerant condensed by the outdoor heat exchanger 4 so as to convert it into a gaseous or liquid refrigerant in a low-temperature and low-pressure state. The indoor heat exchanger 8 evaporates the refrigerant decompressed by the expansion valve 6 so as to convert it into a gaseous refrigerant in a low-temperature and low-pressure state.

An accumulator 10 for gasifying the liquid refrigerant is connected to inlets of the first and second compressors 2 and 3 so as to prevent the liquid refrigerant passing through the indoor heat exchanger 8 from flowing into the first and second compressors 2 and 3. First and second check valves 12 and 13 are respectively installed at each outlet of the first and second compressors 2 and 3 so as to prevent the refrigerant discharged from the first and second compressors 2 and 3 from flowing backward to the first and second compressors 2 and 3.

Herein, according to cooling loads, the first and second compressors 2 and 3 are simultaneously operated or selectively operated, thereby variably changing their total capacity.

Further, an overload protector (not shown; hereinafter, referred to as a "OLP") is interposed between the first and second compressors 2 and 3. When a compressor in a suspension state is overloaded, the OLP serves to cut off power supplied to the stopped compressor. The OLP is turned on and off by heat generated by the stopped compressor in case the stopped compressor is re-operated when pressures at the inlet and the outlet of the stopped compressor are not equalized.

When the cooling load is decreased, parts of the plural compressors are stopped, and when the cooling load is increased and exceeds the total capacity of the operated compressors, the stopped compressors are re-operated.

However, in the conventional air conditioner, when the stopped compressors for satisfying the decreased cooling load are re-operated, if the stopper compressors are re-operated before pressures at the inlets and outlets of the stopped compressors are equalized, the stopped compressors are repeatedly overloaded by the pressure non-equilibrium. Therefore, the OLP is repeatedly driven, thereby causing difficulty in normally re-operating the stopped compressors.

SUMMARY OF THE INVENTION

Therefore, the present invention has been made in view of the above problems, and it is an object of the present invention to provide compressor-controlling device and method for an air conditioner comprising a plurality of compressors, in which stopped compressors for satisfying the decrease of a cooling load are re-operated after pressures at inlets and outlets of the stopped compressors are equalized, thereby normally re-operating the stopped compressors without an overload.

In accordance with one aspect of the present invention, the above and other objects can be accomplished by the provision of a compressor-controlling device for an air conditioner comprising a plurality of compressors, comprising: a movable timer for sensing a stopping time (t) of stopped compressors selected from the plural compressors according to a decrease of a cooling load; a comparison unit for determining whether the stopping time (t) sensed by the movable timer exceeds a designated time (T); and a control unit for re-operating the stopped compressors after a lapse of the designated time (T) when the cooling load is increased, in case the comparison unit judges that the stopping time (t) does not exceed the designated time (T).

In accordance with another aspect of the present invention, there is provided a compressor-controlling method for an air conditioner comprising a plurality of compressors, comprising: the first step of selectively stopping parts of the plural compressors operated in a cooling mode according to a decrease of cooling load; and the second step of re-operating the stopped compressors of the first step after a lapse of a designated time (T) when the cooling load is increased so as to exceed a total capacity of the compressors operated in the first step.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
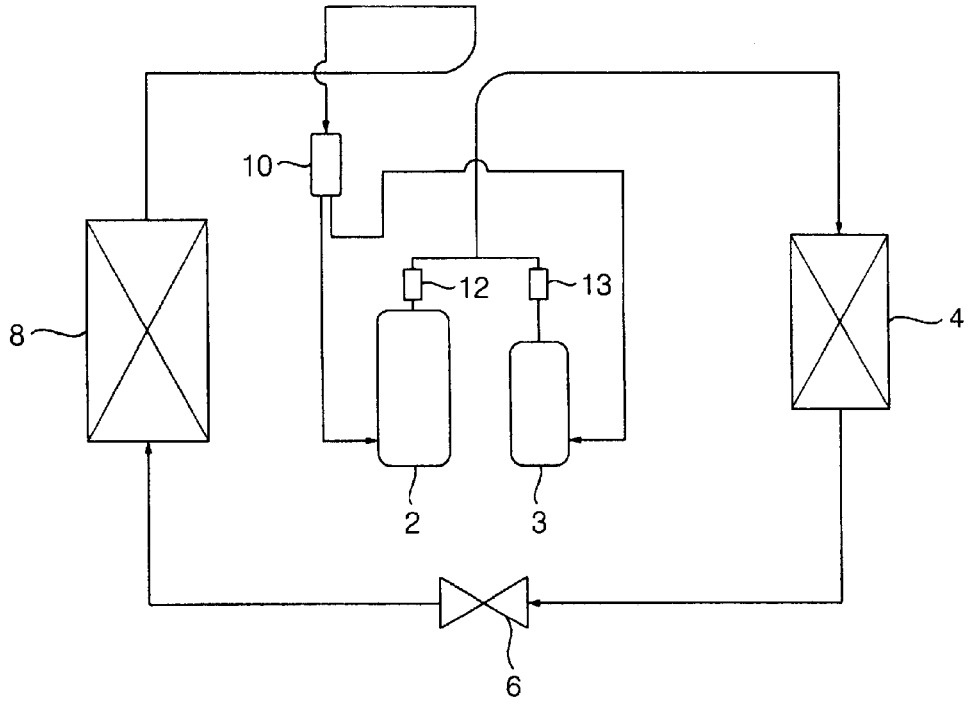
FIG. 1(Prior Art)
FIG. 1 is a block diagram of a conventional air conditioner.
Figure 2:
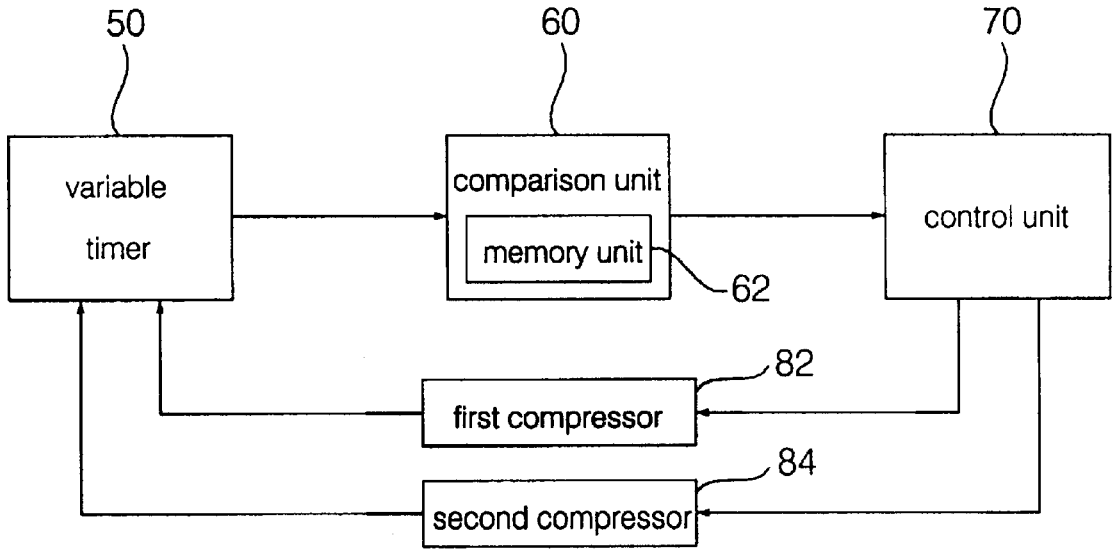
FIG. 2 is a block diagram of a compressor-controlling device for an air conditioner comprising a plurality of compressors in accordance with the present invention.
Figure 3:
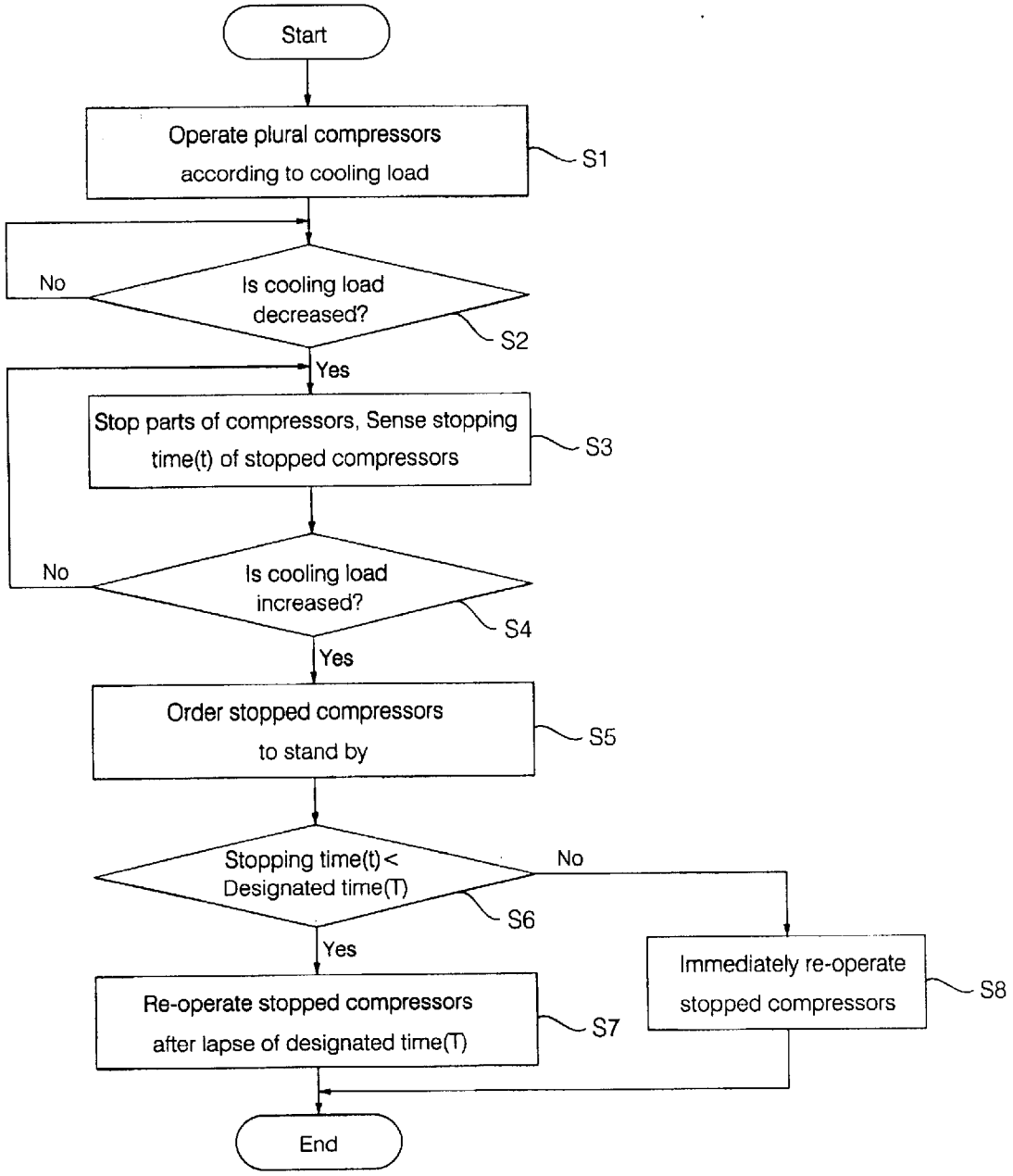
FIG. 3 is a flow chart illustrating a compressor-controlling method for an air conditioner comprising a plurality of compressors in accordance with the present invention.
Figure 4:
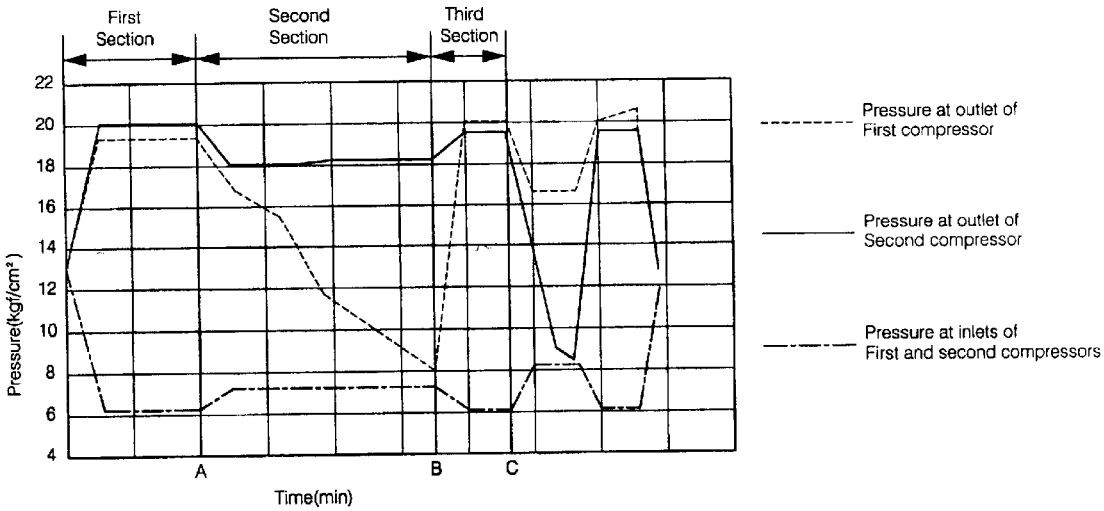
FIG. 4 is a graph illustrating a pressure distribution at the compressors of the air conditioner comprising a plurality of the compressors in accordance with the present invention.

FIG. 2 is a block diagram of a compressor-controlling device for an air conditioner comprising a plurality of compressors in accordance with the present invention. FIG. 3 is a flow chart illustrating a compressor-controlling method for an air conditioner comprising a plurality of compressors in accordance with the present invention. FIG. 4 is a graph illustrating a pressure distribution at the compressors of the air conditioner comprising a plurality of the compressors in accordance with the present invention.

The air conditioner of the present invention comprises a plurality of compressors, an outdoor heat exchanger, an expansion device, and an indoor heat exchanger. A plurality of the compressors are simultaneously or selectively operated according to cooling loads, thereby satisfying the corresponding cooling loads.

Of course, parts of the plural compressors are stopped and then re-operated according to the variation of the cooling load.

Particularly, in case the stopped compressors are re-operated according to the variation of the cooling load, in order to stably drive the entire system of the air conditioner, as shown in FIG. 2, the compressor-controlling device for the air conditioner comprising a plurality of the compressors comprises a movable timer 50, a comparison unit 60, and a control unit 70. The movable timer 50 senses a stopping time (t) of a stopped compressor selected from first and second compressors 82 and 84 having the same or different capacities according to the decrease of a cooling load. The comparison unit 60 determines whether the stopping time (t) sensed by the movable timer 50 exceeds a designated time (T) The control unit 70 re-operates the stopped compressor after a lapse of the designated time (T) when the cooling load is increased, in case the control unit 70 judges that the stopping time (t) does not exceed the designated time (T).

Herein, when the first and second compressors 82 and 84 are operated according to the cooling loads, a pressure difference between inlets and outlets of the first and second compressors 82 and 84 is generated by circulating a refrigerant via the inlets and the outlets of the first and second compressors 82 and 84. The designated time (T) denotes a time taken to remove the pressure difference between the inlets and the outlets of the stopped compressors when parts of the total compressors are stopped according to the decreases of the cooling load.

Further, the comparison unit 60 includes a memory unit 62 in which the above-designated time (T) is stored.

One compressor selected from the first and second compressors 82 and 84 is stopped according to the decrease of the cooling load. Then, when the cooling load is increased prior to a lapse of the designated time (T), the control unit 70 re-operates the stopped compressor after the lapse of the designated time (T). On the other hand, when the cooling load is increased after the designated time (T), the control unit 70 immediately re-operates the stopped compressor.

That is, in case the stopped compressor is re-operated when the pressures at the inlet and the outlet of the stopped compressor are not equalized, an OLP is driven, thereby preventing the stopped compressor from being normally operated. Therefore, in this case, after the lapse of the designated time (T), the stopped compressor is re-operated.

With reference to FIG. 3, the compressor-controlling method for the air conditioner comprising a plurality of the compressors in accordance with the present invention is described as follows.

In first step, when the air conditioner is driven, the plural compressors are operated according to the cooling load. (S1)

Herein, the refrigerant is circulated through the compressors, the outdoor heat exchanger (the condenser), the expansion valve, and the indoor heat exchanger (the evaporator).

In second step, the air conditioner continuously senses the cooling load during the operation of the plural compressors in first step. Herein, when the cooling load is decreased, parts of the compressors are selectively stopped according to the decreased degree of the cooling load but the other compressors are continuously operated. (S2)

In third step, the stopping time (t) of the stopped compressors stopped according to the decreased degree of the cooling load in second step is sensed. (S3)

In fourth step, the air conditioner continuously senses the cooling load during the stoppage of the parts of the compressors, thereby determining whether the cooling load is increased or decreased. (S4)

In fifth step, in case the increase of the cooling load is sensed by the air conditioner in fourth step, parts or all of the stopped compressors of second step stand by so as to be re-operated according to the increased degree of the cooling load. (S5)

However, when the cooling load is decreased, the stopped compressors of second step continuously maintain their stopped states.

In sixth step, in case the stopping time (t) of the stopped compressors in standby states of fifth step is shorter than the designated time (T), the stopped compressors are re-operated after the lapse of the designated time (T). (S6 and S7)

That is, the stopped compressors maintain their standby states until the lapse of the designated time (T), and then are re-operated after the lapse of the designated time (T).

Herein, the designated time (T) is time taken to achieve the pressure equilibrium between the inlets and the outlets of the stopped compressors. The designated time (T) is experimentally determined and previously stored within the memory unit 62 of the comparison unit 60.

However, in case the stopped time (t) of the stopped compressors in the standby states of fifth step is larger than the designated time (T), the stopped compressors are immediately re-operated. (S8) With reference to FIG. 4, the operations of the two compressors in each step of the above-described compressor-controlling method of the air conditioner are described in more detail as follows.

In first section, when first and second compressors 82 and 84 are simultaneously operated according to the cooling load, the pressures at the outlets of the first and second compressors 82 and 84 are rapidly increased and the pressures at the inlets of the first and second compressors 82 and 84 are rapidly decreased. Then, the pressures at the outlets and the inlets of the first and second compressors 82 and 84 are uniformly maintained.

Next, in second section, when the cooling load is decreased and then the first compressor 82 is stopped, the pressure at the outlet of the first compressor 82 is slowly decreased and the pressures at the inlets of the first and second compressors 82 and 84 are slightly increased.

Herein, the designated time (T) denotes a time taken to equalize the pressures at the outlet and the inlet of the first compressor 82.

However, although the cooling load is increased in second section, the first compressor 82 is not immediately re-operated but maintains its standby state during the designated time (T).

In third section, when the pressures at the outlet and the inlet of the first compressor 82 are equalized, the first compressor 82 is re-operated. Then, the pressure at the outlet of the first compressor 82 is rapidly increased and then uniformly maintained, and the pressures at the inlets of the first and second compressors 82 and 84 are slightly decreased and then uniformly maintained.

As apparent from the above description, the present invention provides compressor-controlling device and method for an air conditioner comprising a plurality of compressors, in which stopped compressors for satisfying the decrease of a cooling load are re-operated after a lapse of a designated time for equalizing pressures at inlets and outlets of the stopped compressors, thereby normally re-operating the stopped compressors without an overload so as to variably change the total capacity of the plural compressors and improving the reliability of products.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A compressor-controlling device for an air conditioner comprising a plurality of compressors, comprising:

a movable timer for sensing a stopping time (t) of stopped compressors selected from the plural compressors according to a decrease of a cooling load;

a comparison unit for determining whether the stopping time (t) sensed by the movable timer exceeds a designated time (T); and a control unit for re-operating the stopped compressors after a lapse of the designated time (T) when the cooling load is increased, in case the comparison unit judges that the stopping time (t) does not exceed the designated time (T).

2. The compressor-controlling device for an air conditioner comprising a plurality of compressors as set forth in claim 1, wherein the designated time (T) is a time taken to equalize pressures at inlets and outlets of the stopped compressors according to the decrease of the cooling load.

3. The compressor-controlling device for an air conditioner comprising a plurality of compressors as set forth in claim 1, wherein the comparison unit includes a memory unit storing the designated time (T).

4. The compressor-controlling device for an air conditioner comprising a plurality of compressors as set forth in claim 1, wherein the control unit immediately re-operates the stopped compressors when the cooling load is increased after the lapse of the designated time (T).

5. A compressor-controlling method for an air conditioner comprising a plurality of compressors, comprising:

the first step of selectively stopping parts of the plural compressors operated in a cooling mode according to a decrease of cooling load; and the second step of re-operating the stopped compressors of the first step after a lapse of a designated time (T) when the cooling load is increased so as to exceed a total capacity of the compressors operated in the first step.

6. The compressor-controlling method for an air conditioner comprising a plurality of compressors as set forth in claim 5, wherein the first step further includes the step of measuring a stopping time (t) of the stopped compressors according to the decrease of the cooling load.

7. The compressor-controlling method for an air conditioner comprising a plurality of compressors as set forth in claim 5, wherein the designated time (T) is a time taken to equalize pressures at inlets and outlets of the stopped compressors according to the decrease of the cooling load.

8. The compressor-controlling method for an air conditioner comprising a plurality of compressors as set forth in claim 7, wherein the second step includes:

the first sub-step of comparing the stopping time (t) of the stopped compressors during the first step to the designated time (T), when the cooling load is increased; and the second sub-step of re-operating the stopped compressors after the lapse of the designated time (T) when the stopping time (t) of the stopped compressors does not exceed the designated time (T) of the first sub-step.

9. The compressor-controlling method for an air conditioner comprising a plurality of compressors as set forth in claim 8, wherein the second step further includes the step of immediately re-operating the stopped compressors when the stopping time (t) of the stopped compressors exceeds the designated time (T) in the first sub-step.

* * * * *